US011001478B2

(12) United States Patent
Wen et al.

(10) Patent No.: US 11,001,478 B2
(45) Date of Patent: May 11, 2021

(54) MODULAR ELEVATOR SHEAVE

(71) Applicants: Xu Ming Wen, Shaoxing (CN); Gui Lin Liang, Shaoxing (CN); Ming Wei Wang, Shaoxing (CN); Fang Chi Zhang, Shaoxing (CN); Chun Lan Yu, Shaoxing (CN)

(72) Inventors: Xu Ming Wen, Shaoxing (CN); Gui Lin Liang, Shaoxing (CN); Ming Wei Wang, Shaoxing (CN); Fang Chi Zhang, Shaoxing (CN); Chun Lan Yu, Shaoxing (CN)

(73) Assignee: ZHEJIANG XCC GROUP CO., LTD., Taipei (TW)

( * ) Notice: Subject to any disclaimer, the term of this patent is extended or adjusted under 35 U.S.C. 154(b) by 0 days.

(21) Appl. No.: 15/595,955

(22) Filed: May 16, 2017

(65) Prior Publication Data

US 2017/0349410 A1 Dec. 7, 2017

(30) Foreign Application Priority Data

Jun. 7, 2016 (CN) ..... 201620548539.5

(51) Int. Cl.
*B66B 15/02* (2006.01)
*B66D 3/04* (2006.01)
*B66D 3/06* (2006.01)

(52) U.S. Cl.
CPC ..... *B66B 15/02* (2013.01); *B66D 3/06* (2013.01)

(58) Field of Classification Search
CPC ..... B66B 15/02; B66B 15/04; B66B 9/00; B66D 3/04
See application file for complete search history.

(56) References Cited

U.S. PATENT DOCUMENTS 3,844,536 A * 10/1974 Chadwick, Jr. ..... H01B 13/00 174/5 SG
4,039,141 A * 8/1977 Lindsey ..... H01R 4/64 174/5 SG
4,069,921 A * 1/1978 Raugulis ..... B66C 1/34 212/274
5,025,893 A * 6/1991 Saito ..... B66B 7/06 187/266
8,839,912 B2 * 9/2014 Dominguez ..... B66B 11/0206 187/266
2011/0284812 A1 * 11/2011 Lindfors ..... B22D 19/04 254/416
2016/0236909 A1 * 8/2016 Lampinen ..... B66B 15/04
2017/0081151 A1 * 3/2017 Han ..... B66B 15/02
2017/0267497 A1 * 9/2017 Ma ..... B66B 9/00
2018/0029831 A1 * 2/2018 Renvall ..... B66B 15/02
2018/0162699 A1 * 6/2018 Cambruzzi ..... B66B 15/02
2019/0047826 A1 * 2/2019 Lee ..... B66B 15/04

* cited by examiner

*Primary Examiner* — Michael E Gallion
(74) *Attorney, Agent, or Firm* — Alexander Chen, Esq.

(57) ABSTRACT

A modular elevator sheave comprises a mandrel body, wherein multiple sheave units are arranged side by side along the mandrel body, and wherein, the outer wall of the outer circumference of the sheave unit is provided with a groove. In this structural composition, the mandrel body with multiple sheave units, which increases the overall strength and rigidity of the sheave. Furthermore, the number of sheave unit used can be increase and decrease depending on the need or situation, and it should be noted that since the sheave unit can be replaced individually when damaged, it is easier to maintain and reduce repairing costs.

3 Claims, 2 Drawing Sheets

MODULAR ELEVATOR SHEAVE

BACKGROUND OF THE INVENTION

1. Field of the Invention

The present invention relates generally to sheaves for guiding cables in the elevators, especially to a modular elevator sheave unit.

2. Description of Related Art

Commerical elevators typically use multiple of cable sheaves as part of driving system to operate elevetor cart. A typical elevator sheave is shown as FIG. 1, it generally comprises a mandrel body having a bearing on both ends, and a sheave unit is attached to the bearing. The sheave unit may have multiple grooves between two flanges around its circumference for which the drive elements of a commerical elevator, such as ropes, cables or belts that run over the sheave unit inside the grooves. Typically, the number of grooves inside the sheave unit is fixed so that the number of drive elements can be used is limited to the number of grooves. In addition, because the speed of each drive elements that run over the grooves might be inconsistent which causes slips among the drive elements, which would generate noise and shorten usage life of the sheave unit or drive elements.

SUMMARY OF THE INVENTION

The present invention provides a solution to the above-identified problems by providing a modular elevator sheave. The sheave comprises a mandrel body, where multiple sheave units are provided on the mandrel body to increase the strength and rigidity of the overall sheave. More specific, the number of sheave units provided on the mandrel body can be easily increased and decreased depending on the need. Furthermore, the sheave units can be replaced individually when damaged, therefore, simplified the overall sheave design, and it is easier to maintain and reduce repairing costs.

In order to achieve above-identified benefits, the present invention provides a modular elevator sheave comprises a mandrel body and multiple sheave units arranged side by side along the mandrel body. Wherein, a groove is provided about the center of the outer wall of the outer circumference of the of each sheave units. Wherein, the inner wall of the inner circumference of the sheave unit and the outer wall of the mandrel body forms a transit fit for the selected drive element.

Wherein, the end faces of the inner circumference of any two adjacent sheave units are oppressed with each other, and the end faces of the outer circumference of any two adjacent sheave units are apart from each other.

Wherein, the sheave unit comprises an outer circumference, an inner circumference, a fixing frame, two rows of ball body and a seal ring. The seal ring is provided in between the outer circumference and the inner circumference, and the two rows of ball body are provided on respectively on the grooves of the two ends of the sheave unit and the fixing frame secures the two rows of ball body within the sheave unit.

Wherein, the groove bottom of groove of the outer circumference is curved and the angle between the groove bottom and the two side wall of the groove is a curved transition fit wall.

The inner walls of the two end faces of the outer circumference 1 and the inner circumference are provided with installation grooves, wherein, the seal ring is embedded within the respective installation groove, wherein, the seal ring is clamped in between the outer circumference and the inner circumference.

The mandrel body is provided with multiple abrasion resistance paddings, the abrasion resistance padding are arranged in between the end faces of the inner circumferences of any two adjacent sheave unit.

The advantages that the present invention provides are: comparing to the current structure characteristics, the present invention provides the mandrel body with multiple sheave units, which increases the overall strength and rigidity of the sheave. Furthermore, the number of sheave unit used can be increase and decrease depending on the need or situation, and it should be noted that since the sheave unit can be replaced individually when damaged, it is easier to maintain and reduce repairing costs.

DETAILED DESCRIPTION OF THE INVENTION

Figure 1:
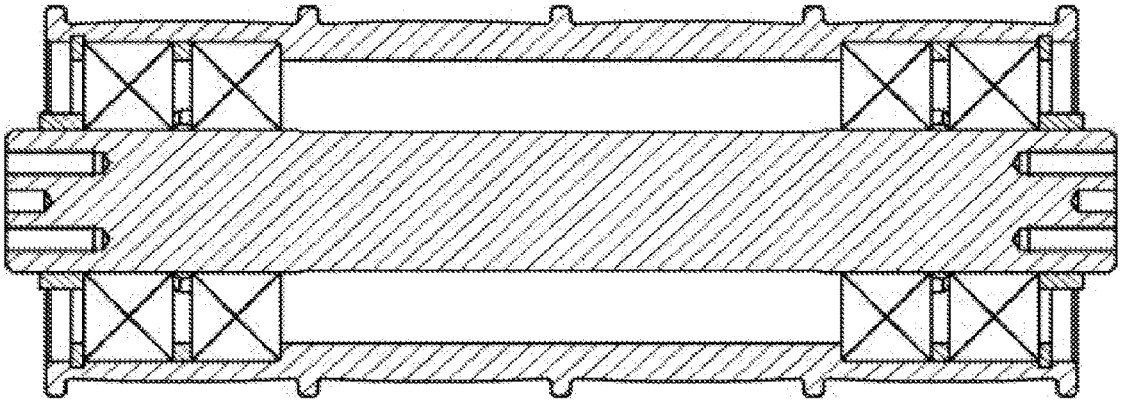
FIG. 1 is a structural illustration of current elevator sheave.
Figure 2:
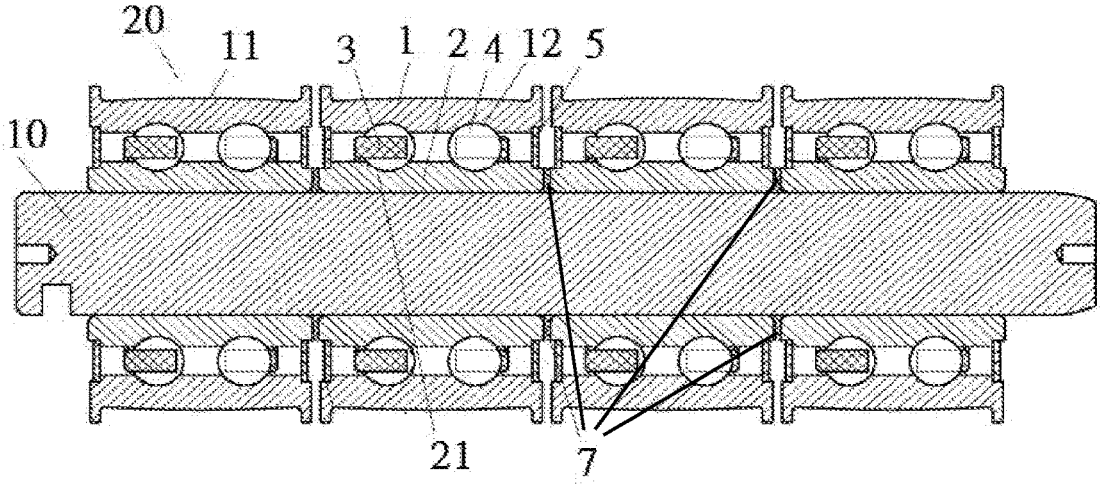
FIG. 2 is a structural illustration of the present invention.
Figure 3:
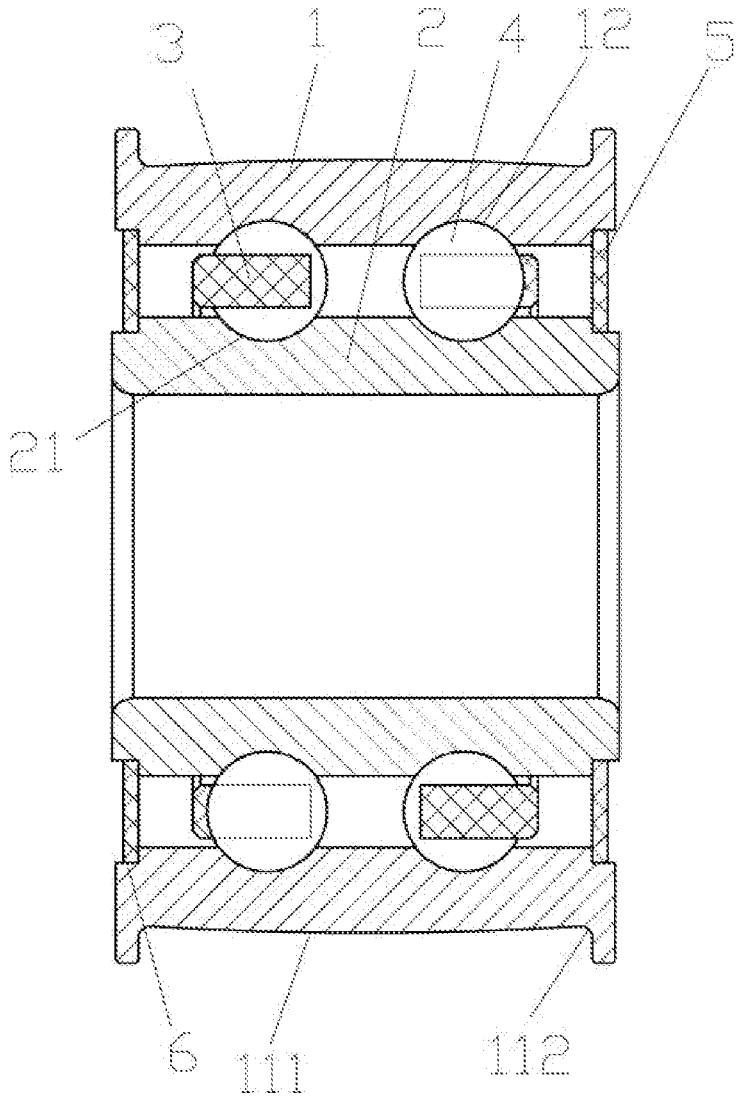
FIG. 3 is a structural illustration of the sheave unit of the present invention

As shown in FIG. 2 and FIG. 3, the present invention a modular elevator sheave comprises a mandrel body 10, wherein multiple sheave units 20 are arranged side by side along the mandrel body 10, and wherein, the outer wall of the outer circumference 1 of the sheave unit 20 is provided with a groove 11.

As a preferred embodiment, the inner wall of the inner circumference 2 of the sheave unit 20 and the outer wall of the mandrel body 10 forms a transit fit for the selected drive element.

As a preferred embodiment, the end faces of the inner circumference 2 of any two adjacent sheave units 20 are oppressed with each other, and the end faces of the outer circumference 1 of any two adjacent sheave units 20 are apart from each other.

As a preferred embodiment, the sheave unit 20 comprises an outer circumference 1, an inner circumference 2, a fixing frame 3, two rows of ball body 4 and a seal ring 5. The seal ring 5 is provided in between the outer circumference 1 and the inner circumference 2, the two rows of ball body 4 is respectively provided on the left and right side of inner groove 12 of the outer circumference 1 and the left and right side of outer grooves 21 of the inner circumference 2. Wherein, the fixing frame 3 secures the two rows of ball body 4 in between the outer circumference and the inner circumference.

As a preferred embodiment, the groove bottom 111 of the groove 11 of the outer circumference is curved, and the angle between the groove bottom 111 and the two side wall of the groove 11 is a curved transition fit wall 112.

As a preferred embodiment, the inner walls of the two end faces of the outer circumference 1 and the inner circumference 2 are provided with installation grooves 6, wherein, the seal ring 5 is embedded within the respective installation groove 6, wherein, the seal ring 5 is clamped in between the outer circumference 1 and the inner circumference 2.

As a preferred embodiment, the mandrel body 10 is provided with multiple abrasion resistance paddings 7, the abrasion resistance padding 7 are arranged in between the end faces of the inner circumferences 2 of any two adjacent sheave unit 20.

As a preferred embodiment, multiple sheave units 20 are arranged side by side along the mandrel body 10. Jump rings can be used on the two ends of the mandrel body 10 to secure the sheave units 20 with the mandrel body 10. Other securing methods, such as panel fixing can be adapted, however, these methods may be considered as current arts and will not be discussed.

As described above, the present invention provides the mandrel body 10 with multiple sheave units 20, which increases the overall strength and rigidity of the sheave unit. Furthermore, the number of sheave unit 20 used can be increase and decrease depending on the need or situation, and it should be noted that since the sheave unit 20 can be replaced individually when damaged, it is easier to maintain and reduce repairing costs.

Furthermore, the present invention provides that the groove bottom 111 of groove 11 of the outer circumference 1 is curved and the angle between the groove bottom 111 and the two side wall of the groove 11 is a curved transition fit wall 112, which, reduces the friction of the drive element on the groove bottom 111 and increases usage life of the sheave unit 20.

Furthermore, the present invention provides the abrasion resistance paddings 7 arranged in between the end faces of the inner circumferences 2 of any two adjacent sheave unit 20, which reduces the friction between any two adjacent sheave units 20 and further increases usage life of the sheave unit 20.

The invention claimed is:

1. A modular elevator sheave comprising: a mandrel body and at least two sheave units mounted side by side along said mandrel body, and wherein, each of said at least two sheave units comprises an outer circumference, an inner circumference, two boring tunnels below said outer circumference and above said inner circumference, balls disposed in said two boring tunnels, a fixing frame that secures said balls in between said outer and inner circumference, at least one circular groove on a side thereof, a seal ring disposed in said at least one circular groove between said outer and inner circumference, and a U-shaped groove on said outer circumference; wherein said modular elevator sheave further comprises at least one abrasion resistance padding that is sandwiched between said at least two sheave units.

2. The modular elevator sheave as claimed in claim 1, wherein, an inner wall of said inner circumference and an outer wall of said mandrel body form a transit fit for a selected drive element.

3. The modular elevator sheave as claimed in claim 1, wherein, faces of said inner circumferences of said at least two sheave units are pressed against each other, and end faces of said outer circumferences said at least two sheave units are apart from each other.

* * * * *